US005509559A

United States Patent [19]

Okano et al.

[11] Patent Number: 5,509,559

[45] Date of Patent: Apr. 23, 1996

[54] CONTAINER FOR TRANSPORTATION

[75] Inventors: Hiroshi Okano; Masanobu Iwatani, both of Kanazawa, Japan

[73] Assignee: Asahi Glass Company Ltd., Tokyo, Japan

[21] Appl. No.: 199,899

[22] Filed: Feb. 22, 1994

[30] Foreign Application Priority Data

Feb. 22, 1993 [JP] Japan ..... 5-032295

[51] Int. Cl.[6] ..... B65D 6/22

[52] U.S. Cl. ..... 220/1.5; 220/7

[58] Field of Search ..... 220/1.5, 4.28, 220/6, 7; 108/54.1, 55.3

[56] References Cited

U.S. PATENT DOCUMENTS

| | | | |
|---|---|---|---|
| 2,868,406 | 1/1959 | Kookogey | 220/7 |
| 3,570,698 | 3/1971 | Dougherty | 220/1.5 |
| 3,765,556 | 10/1973 | Baer | 220/7 |
| 3,865,269 | 2/1975 | Coleman | 220/6 |
| 4,646,928 | 3/1987 | Ono | 220/7 |
| 4,848,618 | 7/1989 | Yuan | 220/7 |
| 5,056,667 | 10/1991 | Coogan | 220/7 |
| 5,251,772 | 10/1993 | Toguchi | 220/7 |

FOREIGN PATENT DOCUMENTS

| | | | |
|---|---|---|---|
| 2630012 | 1/1978 | Germany | 220/1.5 |

*Primary Examiner*—Timothy F. Simone
*Assistant Examiner*—Terrence R. Till
*Attorney, Agent, or Firm*—Oblon, Spivak, McClelland, Maier & Neustadt

[57] ABSTRACT

A container for transportation has a base portion 10, a ceiling portion 20, shutters 30, 30 . . . to be wound up in the ceiling portion 20 and end plates 40, 40, provided with columns 43, 43 at its both sides, which are connected to the ceiling portion 20 so as to be folded up and received in the ceiling portion 20. In compacting the container in non-use, the shutters are lifted up to the ceiling, and the ceiling portion 20 is lifted up from the base portions 10. Then, the ceiling portion is lowered whereby the end plates 40, 40 can be folded, along with the columns 43, 43, under the ceiling portion by utilizing the deadweight of the ceiling portion 20. The container for transportation simplifies folding operations and reassembling operations, and reduces labor cost.

11 Claims, 16 Drawing Sheets

CONTAINER FOR TRANSPORTATION

BACKGROUND OF THE INVENTION

1. Field of the Invention

The present invention relates to a container for transportation which can be used commonly and consistently for any transportation means such as an automobile, a railway car, a ship and so on and which can reduce easily and compactly the outer volume of the container when the container is empty.

2. Discussion of Background

In international transportation or domestic transportation, containers for transportation are often used in order to transport loads in association with several kinds of transportation means.

The containers are generally in a rectangular prism-like body, and dimensions of the portions including the height, the width and the length of the containers are internationally unified and standardized.

Generally, since the outer volume of the containers is not changed between a loaded state or a non-loaded state, it is disadvantageous in a transportation cost when an empty container is carried.

In order to improve such disadvantage, there has been proposed a so-called foldable container in which the outer volume can be reduced in a non-loaded state. The foldable container is constituted by a ceiling portion, a base portion, left and right side walls and front and rear end plates. The container can be assembled into a generally rectangular prism-like shape by using columns which are set up at four corners. Each of the structural pieces can be independently disassembled whereby the container can be folded in a compact form.

The conventional foldable type container has a problem as follows. Since each of the structural pieces can be independently disassembled when the container is not used and reassembled when used, the number of parts necessary for folding and reassembling is increased, and much labor is needed. Namely, the weight of the parts of the container constituted by a large number of structural elements is large, and it is necessary that the parts of the container must be treated by loading machines such as a crane, a fork lift or the like.

SUMMARY OF THE INVENTION

It is an object of the present invention to provide a container for transportation capable of drastically reducing labor for folding and reassembling operations wherein side wall members for forming side walls, and front and rear end plates are connected integrally with a ceiling portion so that they are received in the ceiling portion.

The foregoing and other objects of the present invention can be attained by providing a container for transportation which comprises a base portion, a ceiling portion, side wall members for forming left and right side walls, which can be wound up to the ceiling portion, and end plates for closing front and rear openings formed by the base portion, the ceiling portion and the left and right side walls, wherein the end plates are connected to the ceiling portion so as to be folded up (or pivoted) and received in the same, and each of the end plates is provided with columns at its left and right sides so that they can detachably connect the base portion and the ceiling portion.

As the side wall members, shutters or flexible sheets which can be wound up to the ceiling portion may be used. The side wall members may be formed of members which can be folded in or on the ceiling portion, or are dividable doors or foldable doors. Further, the side wall members may be removable from the side wall portions of the container.

The end plates are expansible and shrinkable in its width direction, and they may be provided with casters at their lower portion.

Further, the ceiling portion may be provided with a lifting means to lift the end plates and receive them in the ceiling portion.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
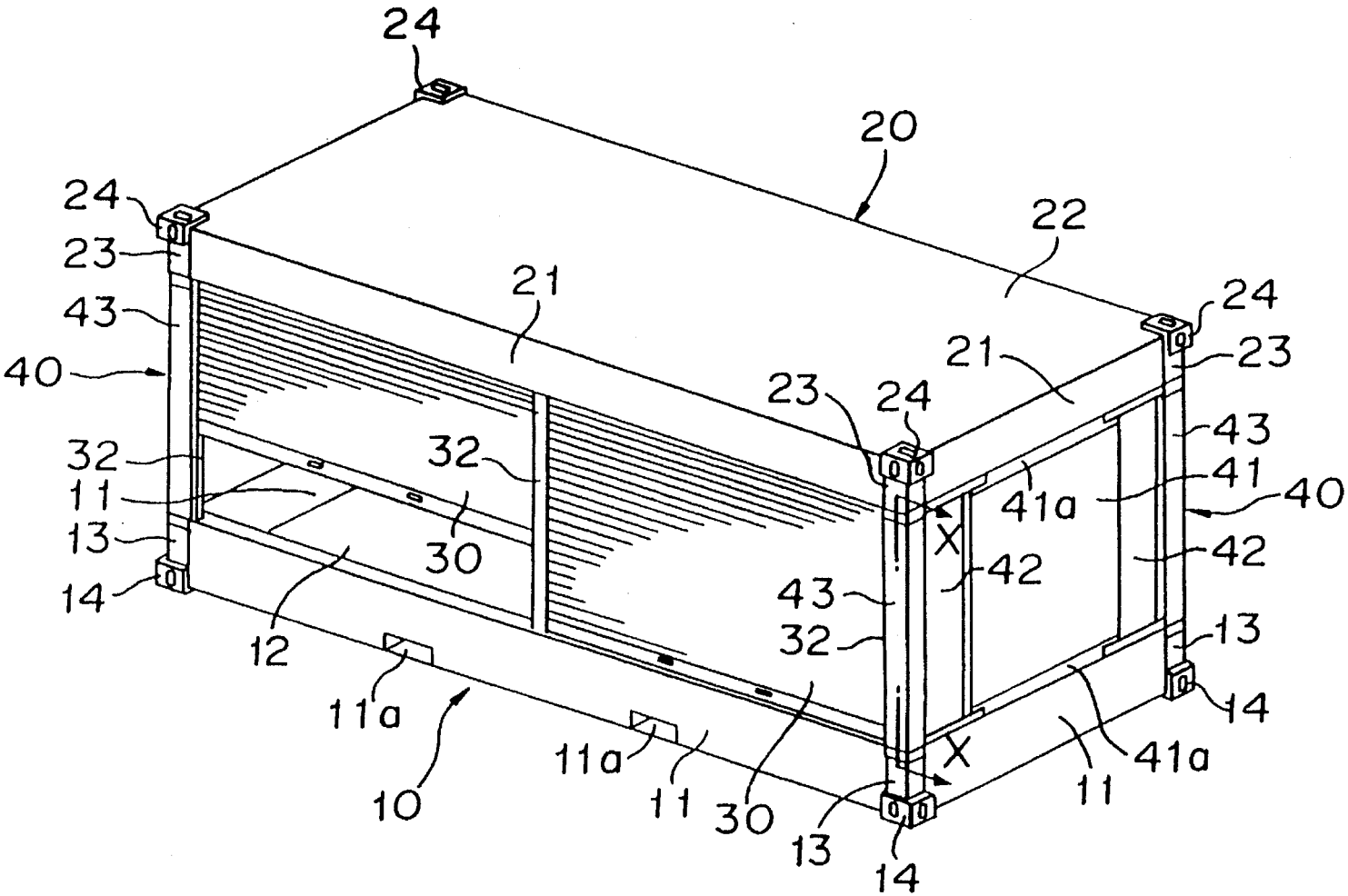
FIG. 1 is a perspective view of an embodiment of the container for transportation according to the present invention wherein the container is in an assembled state.

Referring to the drawings, preferred embodiments of the container for transportation of the present invention will be described in detail.

Referring to FIG. 1, a container for transportation comprises a base portion 10, a ceiling portion 20, shutters 30, 30 . . . for forming left and right side walls, and front and rear end plates 40, 40. However, FIG. 1 shows only two shutters 30, 30 for forming side walls in one side of the container.

Figure 2:
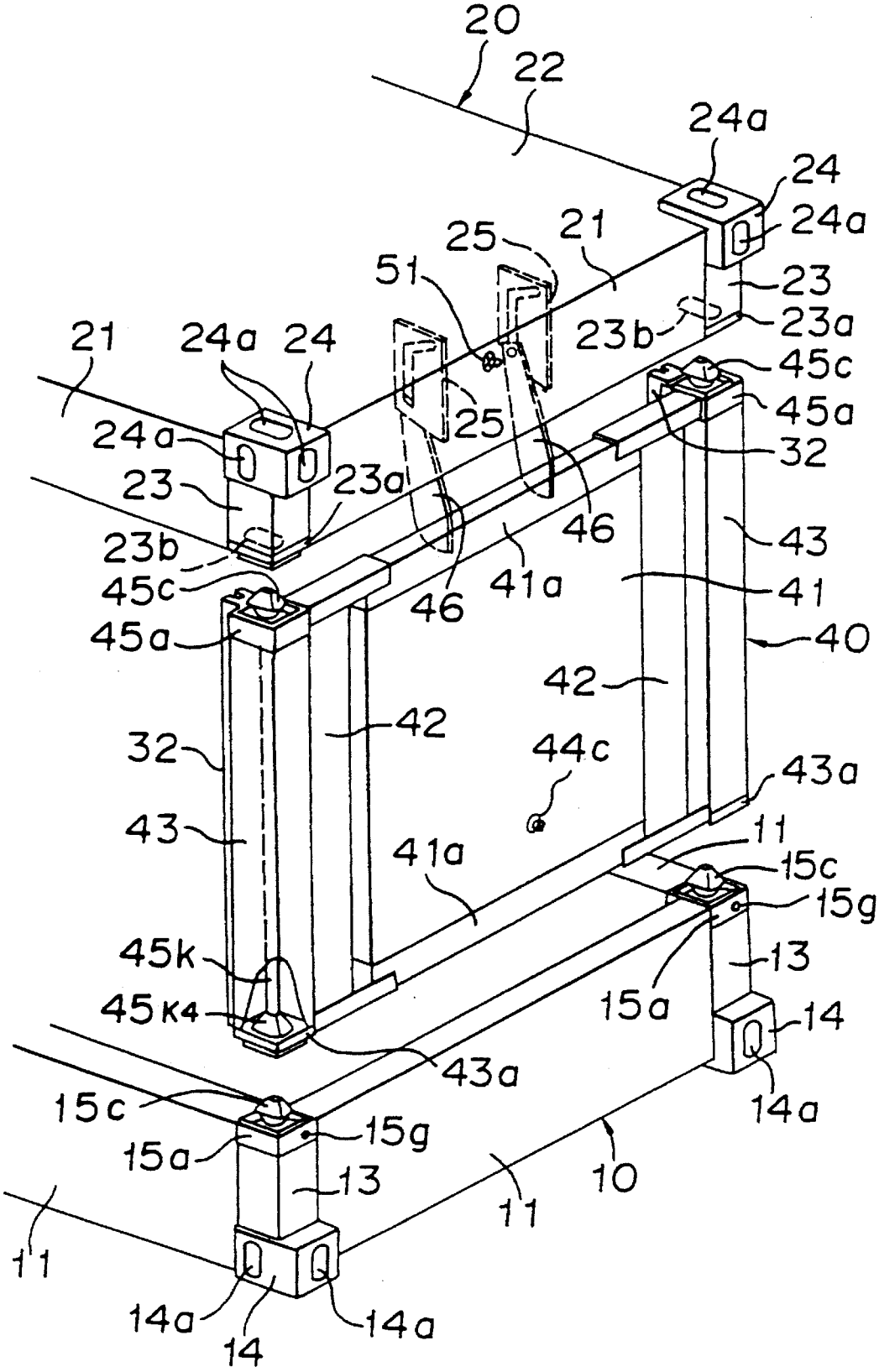
FIG. 2 is a perspective view in an exploded state of an important portion of the container shown in FIG 1.

In FIGS. 1 and 2, the base portion 10 is formed by assembling frame materials 11, 11 . . . into a rectangular framework. Inside the assembled frame materials 11, 11 . . . , a bottom plate 12 is provided, so that the base portion 10 has a shallow box-like body as a whole. At four corner portions of the base portion 10, connecting members 13, 13 . . . having a short quadrangle pillar shape are provided. At the lower part of each of the connecting members 13, a connecting block 14 having elongated holes 14*a*, 14*a* is located so as to connect the container for transportation to another adjacent container for transportation. Further, fork pockets 11*a*, 11*a* are formed in the long side portion of each of the frame materials 11, 11 of the base portion 10.

Figure 3:
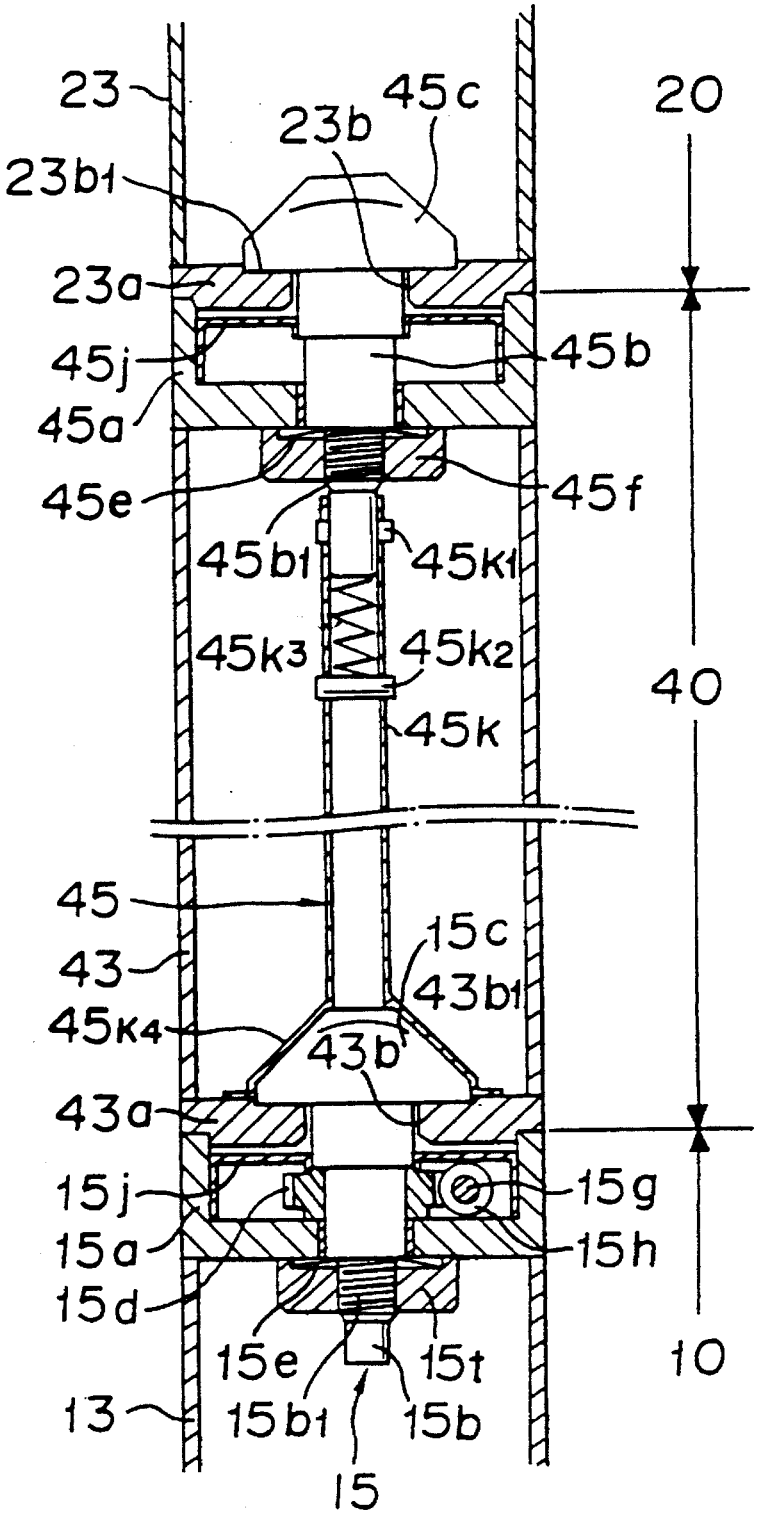
FIG. 3 is an enlarged longitudinal cross-sectional view taken along a line X—X in FIG. 1.

In FIGS. 2 and 3, a connecting means 15 is attached to the top end of each of the connecting members 13.

The connecting means 15 comprises as major elements a small box-like frame 15*a* to be located at the top end of the connecting member 13, a rotating shaft 13*b* having a step portion which penetrates vertically the central portion of the frame 15*a* and pivotably supports the same, and engaging block 15*c* which is fixed to the upper end of the rotating shaft 15*b*. The engaging block 15*c* is exposed above the frame 15*a* and has a truncated pyramidal shape having a substantially flattened head in cross section. A worm gear wheel 15*d* is fixed to an intermediate portion of the rotating shaft 15*b*. A ball head lock nut 15*f* including therein a leaf spring 15*e* is engaged, at the lower portion of the frame 15*a*, with a male screw portion 15*bl* which is formed at the lower portion of the rotating shaft 15*b*. A worm wheel 15*h* fixed to an operating rod 15*g* is engaged with the worm gear wheel 15*d*. The operating rod 15*g* can be operated from the outside of the frame 15*a*. A cover plate 15*j* is provided in the frame 15*a* to protect the worm wheel 15*h* and the worm gear wheel 15*d*.

Referring to FIGS. 1 and 2, the ceiling portion 20 is formed into a rectangular box-like shape having substantially the same size as the base portion 10, the ceiling portion 20 being formed by assembling frame materials 21, 21 . . . for defining four sides and a ceiling plate 22. Connecting members 23, 23 . . . are provided at four corners of the ceiling portion 20, and a connecting block 24 having elongated holes 24*a*, 24*a* . . . is located at the upper portion of each of the connecting members 23. A foot plate 23*a* having a thickened wall is attached to the lower portion of each of the connecting members 23. An elongated engaging hole 23*b*, which corresponds to the shape of the engaging block 15*c*, is formed in the foot plate 23*a* (see FIGS. 2 and 4). A low edge portion is formed at the outer circumference of the bottom surface of the foot plate 23*a* so that it can be fitted to the frame 15*a* of the base portion 10. As shown in FIG. 3, a shallow recess 23*bl* is formed around the engaging hole 23*b* in the direction perpendicularly crossing to the longitudinal axis of the engaging hole 23*b* so that the recess 23*bl* fits the engaging block 15*c*.

Figure 4:
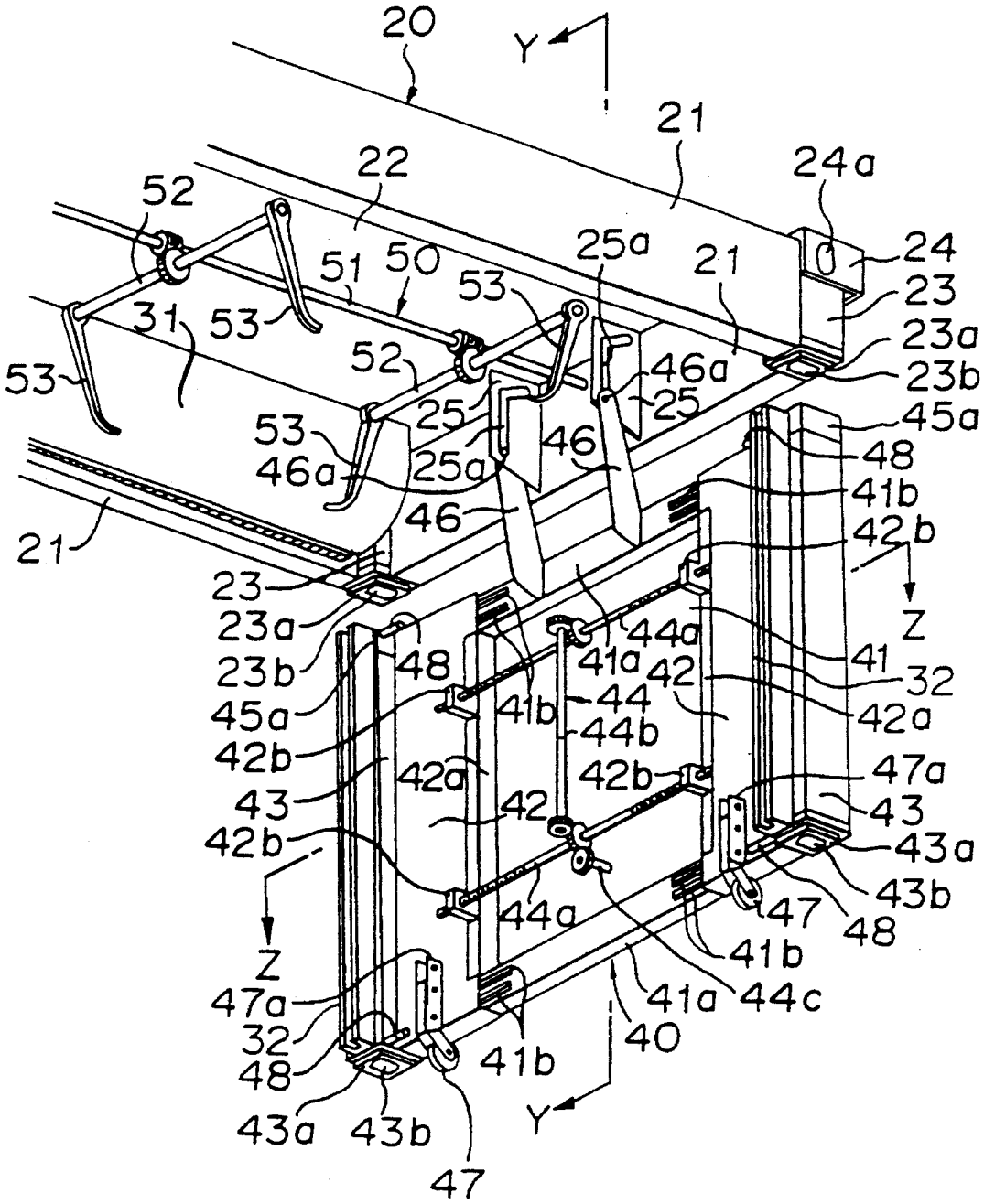
FIG. 4 is a perspective vies in an exploded state of an important portion of the container shown in FIG. 1.

In FIG. 4, shutter casings 31, 31 are located inside the long side portion of the frame materials 21, 21 of the ceiling portion 20 so that they can receive the shutters when they are wound up. Each of the shutters can be received in the ceiling portion 20 when they were wound up in the shutter casings 31. In FIG. 1, a guiding stay 32, which is detachably fitted, is set up between the shutters 30, 30. The other side of each of the shutters 30 is guided by a guide rail 32 which is attached to the end plate 40 (FIGS. 1 and 4).

In FIGS. 2 and 4, the front and rear end plates 40, 40 are respectively connected to the ceiling portion 20 so as to be foldable by means of brackets 25, 25 provided inside the short side portions of the frame materials 21 of the ceiling portion 20.

Figure 5:
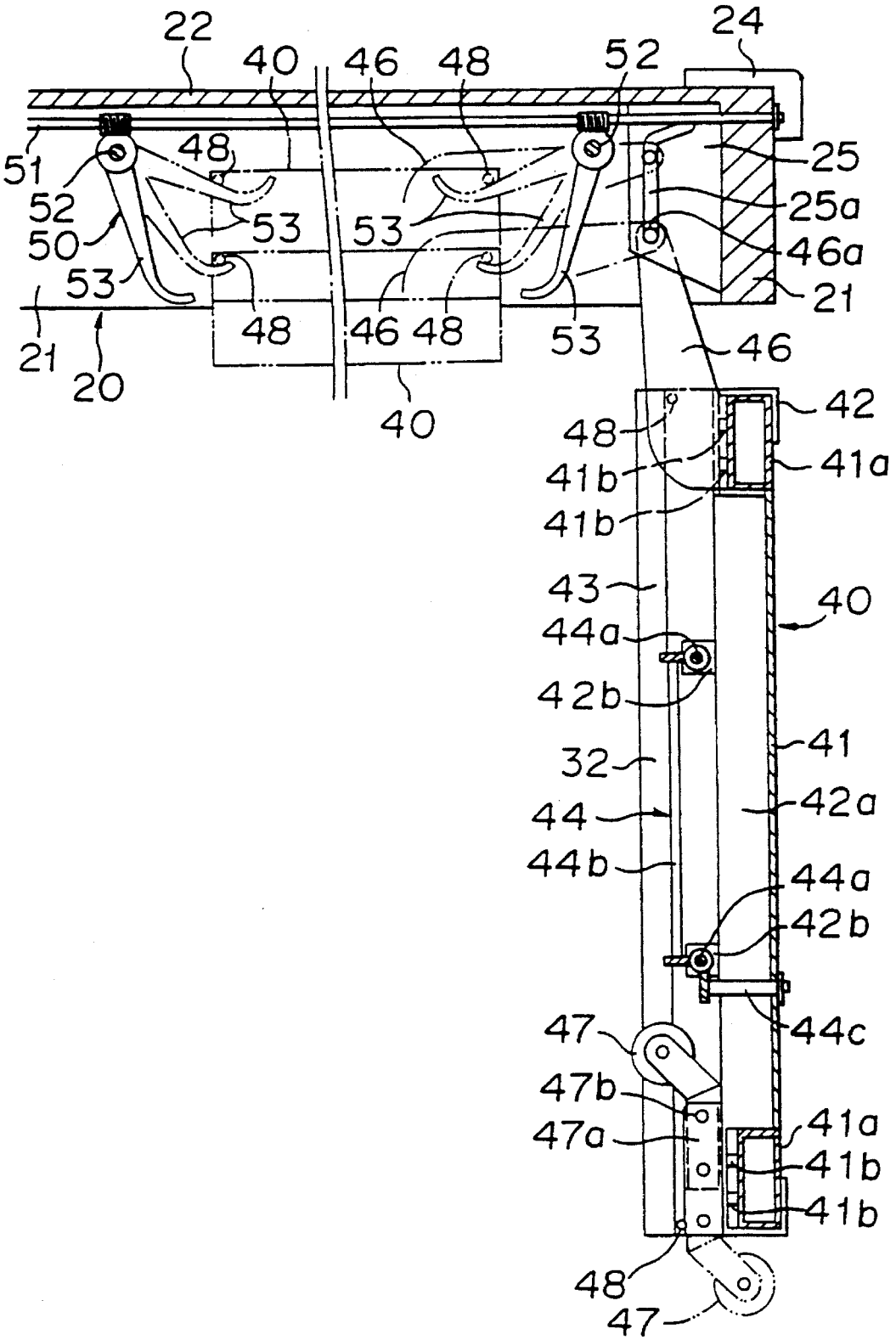
FIG. 5 is a diagram partly cross-sectioned of the portion taken along a line Y—Y in FIG. 4.

Referring to FIGS. 4 and 5, each of the end plates 40 is formed in combination of a fixed plate 41 having reinforcing materials 41*a*, 41*a* at the upper and lower portions, movable plates 42, 42 located at left and right sides of the fixed plate 41 and columns 43, 43 provided at each outer portion of the movable plates 42, 42. Slide rails 41*b*, 41*b* . . . are respectively provided in the inner surface side of the reinforcing materials 41*a*, 41*a*. The upper and lower end portion of each of the movable plates 42 are bent so that the bent portions surround the upper or lower portion of the reinforcing materials 41*a* together with the slide rails 41*b*, 41*b*. Thus, each of the movable plates 42 is guided by the upper and lower reinforcing material 41*a*, 41*a* and slide rails 41*b*, 41*b* . . . so that they can be slidably moved in the width direction of the end plates 40.

Figure 6:
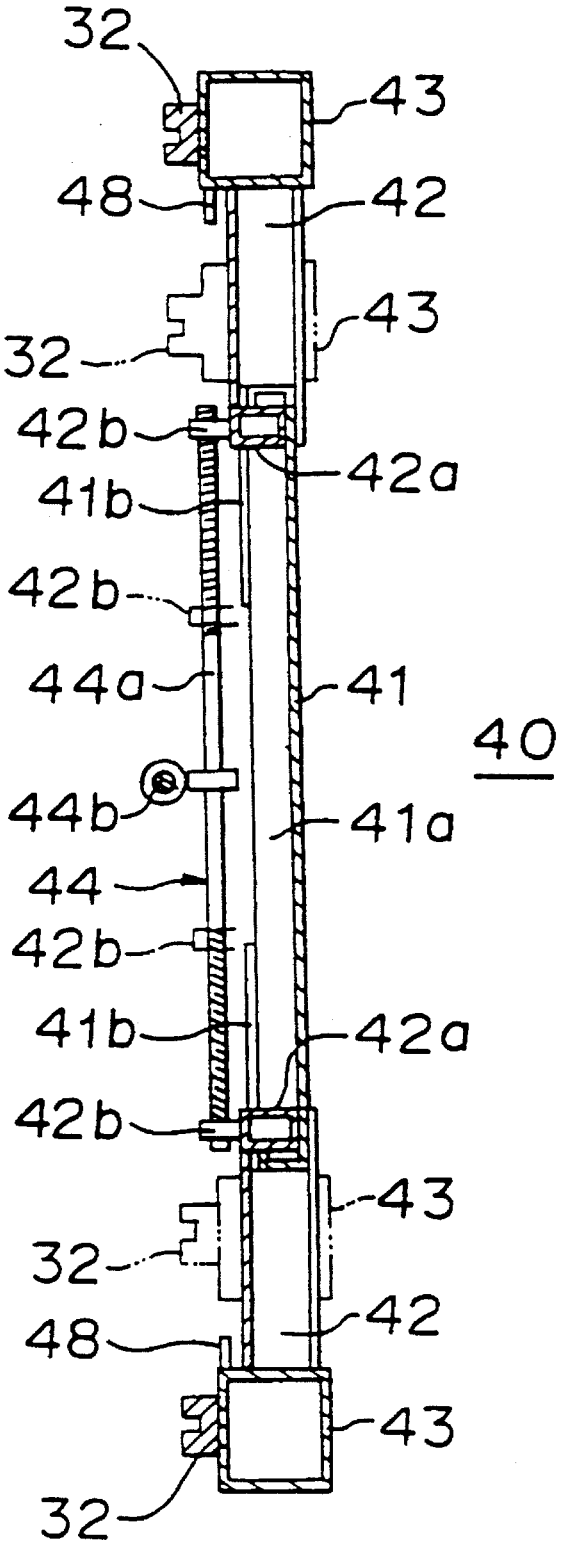
FIG. 6 is a longitudinal cross-sectional view taken along a line Z—Z in FIG. 4.

In FIGS. 4 and 6, a driving means 44 is attached to the inner surface of the fixed plate 41. The driving means 44 is formed in combination of horizontal threaded shafts 44*a*, 44*a* and a vertical connecting shaft 44*b*. The threaded shafts 44*a*, 44*a* and the connecting shaft 44*b* are connected by means of a gear mechanism. Further, they can be driven from the outside of the end plate 40 by operating an operating rod 44*c* which penetrates the fixed plate 41. Reverse screws are formed at both end portions of each of the threaded shafts 44*a* and the reverse screws are respectively engaged with threaded brackets 42*b*, 42*b* formed in the movable plates 42, 42. In this case, each of the threaded brackets 42*b*, 42*b* is fixed to each of the reinforcing materials 42*a* which are vertically located at an edge portion of the inner surface of the movable plate 42. By rotating the threaded shafts 44*a*, 44*a* through the operating rod 44*c*, the movable plates 42, 42 can be moved in the relatively opposite direction with respect to the fixed plate 41 and in the width direction of the each of the end plates (see solid lines and two-dotted chain lines in FIG. 6). Thus, each of the end plates 40 is expandable and retractable in its width direction.

As shown in FIGS. 1 and 2, each of the columns 43, 43 is a rectangular column shape having the same size as the connecting members 13, 23 for the base portion 10 and the ceiling portion 20, and the columns 43, 43 are attached to the outer side edges of the movable plates 42, 42. The entire length of the columns 43, 43 are the same as the height of the end plates 40. The columns 43, 43 are so formed that the movable plates 42, 42 are moved outerside the end plate 40 so that the end plate can have the largest width. Further, the columns 43, 43 are rendered to be the same position as the connecting members 13, 13, 23, 23 for the base portion 10 and the ceiling portion 20. In FIG. 4, a foot plate 43a having a thickened wall, which is the same shape as the foot plate 23*a* for the ceiling portion 20, is attached to the lower portion of each of the columns 43, and the foot plate 43*a* is provided with an engaging hole 43*b*. A guide rail 32 is attached to the inner surface side of each of the columns 43 so as to guide the shutter 30. A shallow recess 43*bl* is formed around the engaging hole 43*b* in the direction perpendicularly crossing the engaging hole 43*b* (FIG. 3).

As shown in FIGS. 2 and 3, a connecting means 45 is installed in each of the columns 43.

The connecting means 45 is installed in a frame 45*a* which is located at the top end of each of the columns 43 and has substantially the same construction as the connecting means 15 for the base portion 10. Namely, the connecting means 45 has as major elements a rotating shaft 45*b* having a step portion which penetrates the central portion of the frame 45*a*, and an engaging block 45*c* attached to the upper end of the rotating shaft 45*b*. The engaging block 45*c* is exposed above the frame 45*a*. The engaging block 45*c* has the same shape as the engaging block 45*c*. A male screw portion 45*bl* is formed at the lower portion of the rotating shaft 45*b*, and a ball head lock nut 45*f* including therein a leaf spring 45*e* is engaged with the male screw portion 45*bl* from the lower side of the frame 45*a*. A cover plate 45*j* is installed inside the frame 45*a* to protect the bearing portion of the rotating shaft 45*b*.

An elongated pipe 45*k* is connected to the lower portion of the rotating shaft 45*b* by means of a pin 45*k*1 in a vertically movable manner. At the lower portion of the pin 45*k*1, another pin 45*k*2 is inserted in the elongated pipe 45*k* and a compression spring 45*k*3 is interposed between the pins 45*k*1 and 45*k*2 so that the elongated pipe 45*k* is downwardly urged by means of the compression spring 45*k*3. A downwardly flared cap 45*k*4 is attached to the lower end of the elongated pipe 45*k*. The cap 45*k*4 is in contact with the upper surface of the foot plate 43*a*. The cap 45*k*4 can close the engaging hole 43*b* or the recess 43*b* formed in the foot plate 43*a* by turning 90° clockwisely or counter-clockwisely the rotating shaft 45*b* and the elongated pipe 45*k*. The cap 45*k*4 is formed to have the outer shape which fits the engaging block 15*c* of the base portion 10. The direction of the flattened portion of the engaged block 15*c* is the same as that of the engaging block 45*c* which is located at the upper portion of the engaging block 15*c*.

In FIGS. 2 and 4, there are shown brackets 46, 46 attached to the inner side surface of the reinforcing material 41*a* which is at the upper portion of the end plate 40 wherein the brackets 46, 46 upwardly extend so as to correspond to the brackets 25, 25 on the side of the ceiling portion 20. At the top end of each of the brackets 46, 46, an engaging pin 46*a* is set up. Each of the engaging pins 46*a* is engaged with an engaging hole 25*a* of each of the brackets 25. The engaging holes 25*a*, 25*a* are respectively vertically extending grooves each being bent obliquely at the upper portion. Accordingly, when the engaging pins 26*a*, 26*a* are located at the lower end of the engaging holes 25*a*, 25*a*, the end plate 40 is swingable around the engaging pins 46*a*, 46*a*. Further, when the engaging pins 46*a*, 46*a* are moved along the engaging holes 25*a*, 25*a*, the end plate 40 is vertically moved with respect to the ceiling portion 20.

Referring to FIGS. 4 and 5, casters 47, 47 are attached to the lower portion of the movable plates 42, 42, of the end plate 40 by means of brackets 47*a*, 47*a*. In this case, a lock pin 47*b* is inserted in each of the brackets 47*a* whereby each of the casters 47 can assume an upward waiting position (a solid line in FIG. 5) and a working position downwardly directed (a two-dotted chain line in FIG. 5). The casters 47 are locked by changing the position.

A pair of engaging pins 48, 48 are set up at upper and lower end portions of each of the columns 43, 43 so as to oppose each other. The engaging pins 48, 48 provided at the upper portions are set up in the frames 45*a*, 45*a* which are located at the upper end of each of the columns 43, 43. On the other hand, the engaging pins 48, 48 located at the lower portion are set up on the foot plates 43*a*, 43*a* which are at the lower end of the columns, 43, 43.

Referring to FIGS. 4 and 5, a lifting means is installed inside the ceiling portion 20.

The lifting means 50 comprises an operating shaft 51 which penetrates the frame materials 21, 21 of a short side of the ceiling portion, two pairs of driving shafts 52, 52 . . . (each pair comprising two driving shafts) which are connected to the operating shaft 51 by means of a worm gear mechanism and which are arranged to perpendicularly intersect the operating shaft 51, and downwardly bent pawls 53, 53 . . . fixed to both ends of each of the driving shafts 52. In this embodiment. The driving shafts 52, 52 . . . and the bent pawls 53, 53 . . . respectively have the length which correspond to the half of the short side of the ceiling portion 20. Further, a pair of the driving shafts 52, 52 are arranged to have a center distance slightly larger than the height of the end plate 40, and the bent pawls 53, 53 . . . attached to any of the driving shafts 52, 52 oppose each other.

By driving for rotating the operating shaft 51 from the outside of the ceiling portion 20, the bent pawls 53, 53 . . . are driven at the same time to assume a waiting position (a solid line in FIG. 5) wherein the pawls are lowered, or a lifting position (a two-dotted chain line in FIG. 5) wherein they are raised. The bent pawls 53, 53 . . . in a waiting position does not interfere with the end plate 40 when the engaging pins 46*a*, 46*a* of the end plate 40 are at the lower end of the engaging holes 25*a*, 25*a* of the brackets 25, 25 (in such case, the end plate 40 is swingable around the engaging pins 46*a*, 46*a*), and even when the end plate 40 is folded at the lower portion and in parallel to the ceiling portion 20. Further, in such condition, when the bent pawls 53, 53 . . . are driven to the raised position, they are quickly engaged with the engaging pins 48 of the end plate 40 respectively (a one-dotted chain line in FIG. 5). Then, the end plate 40 is lifted up so as to be in parallel to the lower surface of the ceiling portion 20.

Thus, the lifting means 50 can accommodate completely the end plate 40 along with the columns 43, 43 in the ceiling portion 20 by driving the bent pawls 53, 53 . . . to the raised position (a two-dotted chain line in FIG. 5). In such case that the end plate 40 is folded and received in the ceiling portion 20, the movable plates 42, 42 are previously moved by means of the driving means 44 so that the width of the end plate 40 is reduced to have a smallest value.

The container for transportation can be regularly assembled by connecting the columns 43, 43 . . . of the end plates 40, 40 to the connecting members 13, 13 . . . of the base portion 10 and the connecting members 23, 23 . . . of the ceiling portion 20 by means of the connecting means 15, 15 . . . of the base portion 10 and the connecting means 45, 45 . . . of the end plates 40, 40 (FIGS. 1 and 3).

In assembling, the engaging block 15*c* of the connecting means 15 is inserted into the engaging hole 43*b* formed in the foot plate 43*a* of the corresponding column 43. Then, the engaging block 15*c* is turned by 90° to fit into the recess 43*bl* formed at the upper surface of the foot plate 43*a*, whereby the engaging block 15*c* can be engaged with the foot plate 43*a*. Similarly, the engaging block 45*c* of the connecting means 45 is engaged with the foot plate 23*a* of the connecting member 23 for the ceiling portion 20. Namely, the columns 43, 43 . . . of the end plates 40, 40 can be maintained in a regular assembled state by connecting the ceiling portion 20 to the base portion 10 by means of the corresponding connecting means 15, 45, respectively.

In this state, the engaging block 15*c* is fitted to the cap 45*k*4 of the connecting means 45 from the lower side. Then, when the operating shaft 15*g* of the connecting means 15 is clockwisely or counter-clockwisely turned, the engaging blocks 15*c*, 45*c* can be turned simultaneously through the rotating shaft 15*b*, the elongated pipe 45*k* and the rotating shaft 45*b*. In this case, the engaging blocks 15*c*, 45*c* are downwardly urged respectively by means of the leaf springs 15*e*, 45*e*. However, when the engaging blocks are to be rotated, they are moved upwardly against the spring action of the leaf springs 15*e*, 45*e* in an amount corresponding to the depth of the recesses 43*bl*, 23*bl*, whereby the engaging blocks 15*c*, 45*c* can escape from the recesses 43*bl*, 23*bl*.

When the container for transportation is to be folded, the engaging blocks 15*c*, 45*c* are turned by 90° by operating the corresponding operating shafts 15*g*, 15*g*. Then, the engaging blocks 15*c*, 45*c* are aligned to the direction of the corresponding engaging holes 43*b*, 23*b*. Then, the ceiling portion 20 is lifted up by means of a crane or the like (not shown) to separate the end plates 40, 40 from the base portion 10. Also, the end plates 40, 40 can be separated from the ceiling portion 20 (FIG. 2). Namely, the columns 43, 43 of each of the end plates 40 can detachably connect the ceiling portion 20 and the base portion 10 by means of the corresponding connecting means 15, 45. In this case, however, the shutters 30, 30 . . . should be previously wound up in the shutter casings 31, 31 . . . of the ceiling portion, and the guide stays 32, 32 should be removed.

Then, the casters 47, 47 for each of the end plates 40 are brought to an operating position, and at the same time, the width of the end plates 40 is rendered to be the smallest value by means of the driving means 44. Further, the lifting means 50 of the ceiling portion 20 drives the bent pawls 53, 53 . . . to a waiting position.

Figure 7:
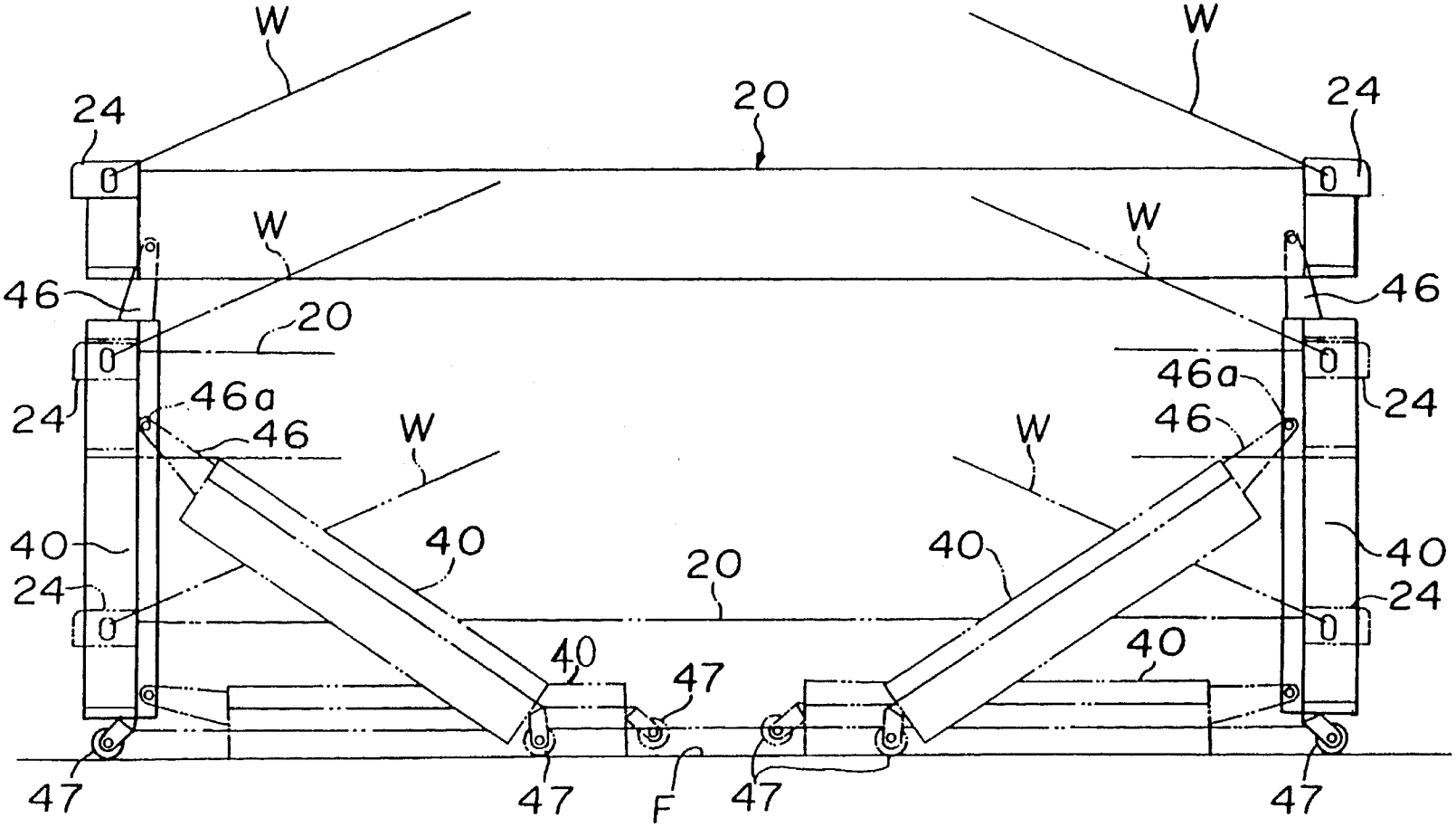
FIG. 7 is a diagram showing the function of the container according to the present invention.

Then, the ceiling portion 20 is moved laterally above a flat floor F and is lowered so that the casters 47, 47 . . . are rested on the floor F (a solid line in FIG. 7). In FIG. 7, the ceiling portion 20 is suspended in parallel to the floor surface F by means of a crane (not shown) through wires W, W.

When the ceiling portion 20 is further lowered (a one-dotted chain line in FIG. 7), the casters 47, 47 roll on the floor surface F, and the end plates 40, 40 are folded to the lower surface of the ceiling portion 20 by the turning movement around the engaging pins 46*a*, 46*a*. In this case, it is sufficient that the ceiling portion 20 is simply lowered because the end plates 40, 40 can be folded by utilizing the deadweight of the ceiling portion 20. When the ceiling portion 20 is sufficiently lowered (a two-dotted chain line in FIG. 7), the end plates 40, 40 are finally folded at the lower portion of the ceiling portion 20 in parallel to the same. Then, the bent pawls 53, 53 . . . of the lifting means 50 of the ceiling portion 20 are driven from the waiting position to the lifted position, whereby the end plates 40, 40 can be completely accommodated in the ceiling portion 20 together with the columns 43, 43 . . . (a two-dotted chain line in FIG. 5).

Figure 8:
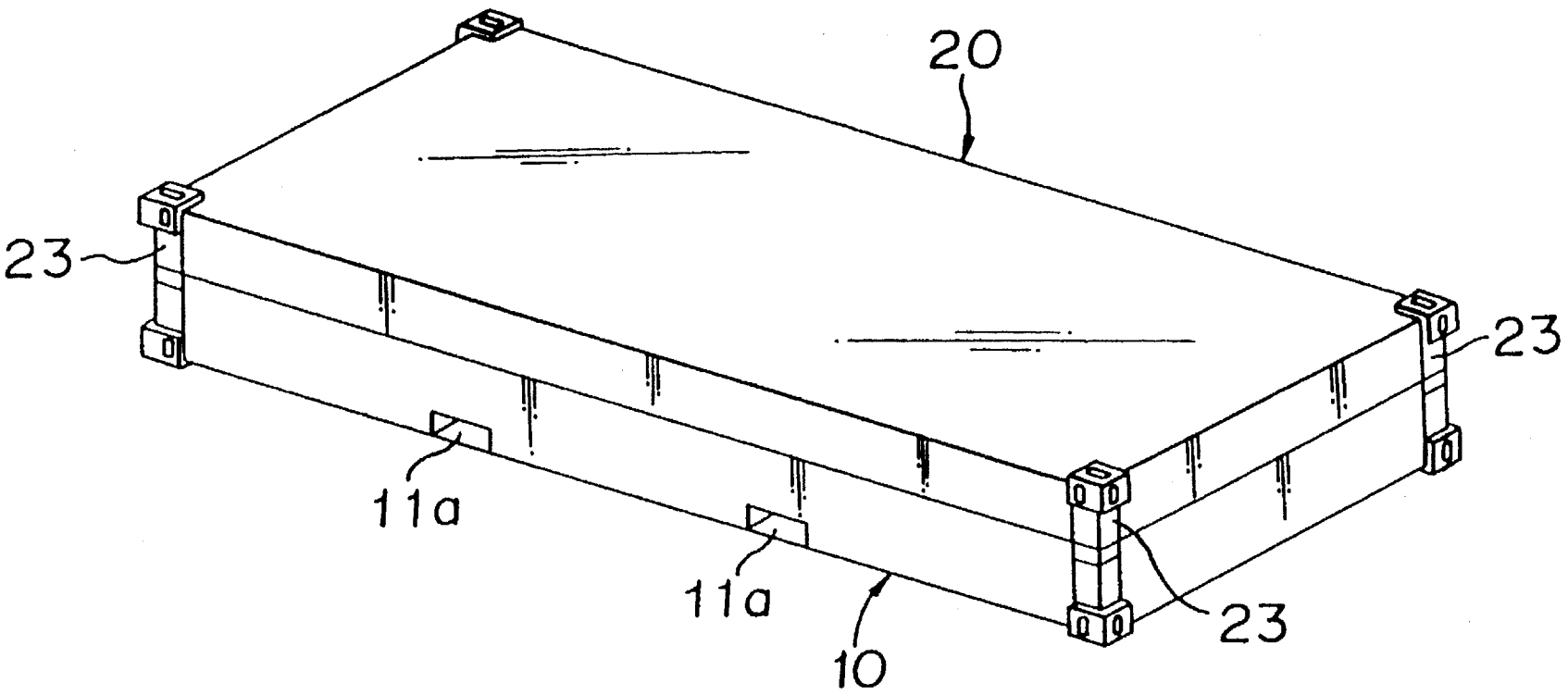
FIG. 8 is a perspective view of the container of the present invention in a folded or collapsed state.

Thus, the ceiling portion 20 which has accommodated the end plates 40, 40 and the shutters 30, 30 . . . is overlaid on and connected to the base portion 10, by which the outer volume can be compactly reduced (FIG. 8). In this case, the base portion 10 and the ceiling portion 20 can be integrally connected by inserting the engaging block 15*c* of each of the connecting means 15 of the base portion 10 into the engaging hole 23*b* of the corresponding connecting member 23 of the ceiling portion 20, and by turning the engaging block 15*c* by 90° by means of the operating rod 15*g*. Thus, the folded container for transportation can be easily treated by a loading machine such as a fork lift by utilizing the fork pockets 11*a*, 11*a*. The guide stays 32, 32 which have been removed in the folding operation can be received in either the ceiling portion 20 or the base portion 10 prior to joining them.

Further, thus folded container for transportation can be assembled in a regular assembled state by assembling the folded container in accordance with the reverse steps of this assembling operations.

The operating rod 15*g* of each of the connecting means 15, the operating rod 44*c* of each of the driving means 44 and the operating shaft 51 of the lifting means 50 can be operated from the outside of the container for transportation. These operating rods and operating shaft can be easily operated by a suitable manual tool, or a portable type air-assisted or motor-assisted driving tool.

Description will be made as to a case that a large quantity of glass plates are to be transported by using the container for transportation described above. In order to transport glass plates, a rest for transporting the glass plates is used in the container for transportation. As such rest, various types of rest such as an assembling type, an extensible type, a foldable type or a combination of these types are used.

A rest comprises a base, a plurality of extensible means which are set up in an alignment form on the central portion of the base and each of which is formed by assembling link arms in a scissors form wherein the length of the assembled link arms is reduced successively from the bottom to the top, upper pressing members attached to the top of each of the extensible means, front pressing members for connecting the upper pressing members to the base and side pressing members located at both end portions of the base.

Each of the extensible means may be so constructed that a connecting rod with a shock absorber penetrates and connects the joint of each of the link arms.

Further, each of the front pressing members may be detachable; each of the upper pressing members may be opened upwardly, and each of the side pressing members may be opened backwardly at its rearmost retracted position.

A preferred embodiment of a rest will be described in detail with reference to FIGS. 9 through 18.

Figure 9:
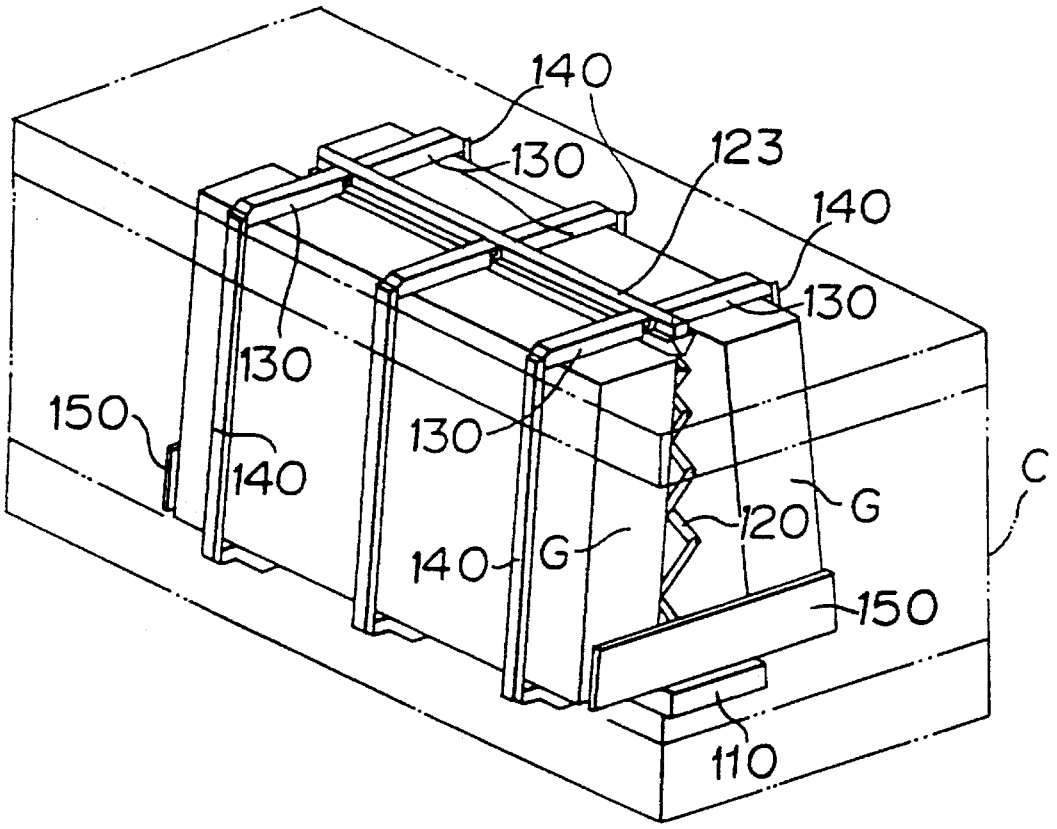
FIG. 9 is a perspective view of an embodiment of a rest for transporting glass plates used for and received in the container for transportation according to the present invention.
Figure 10:
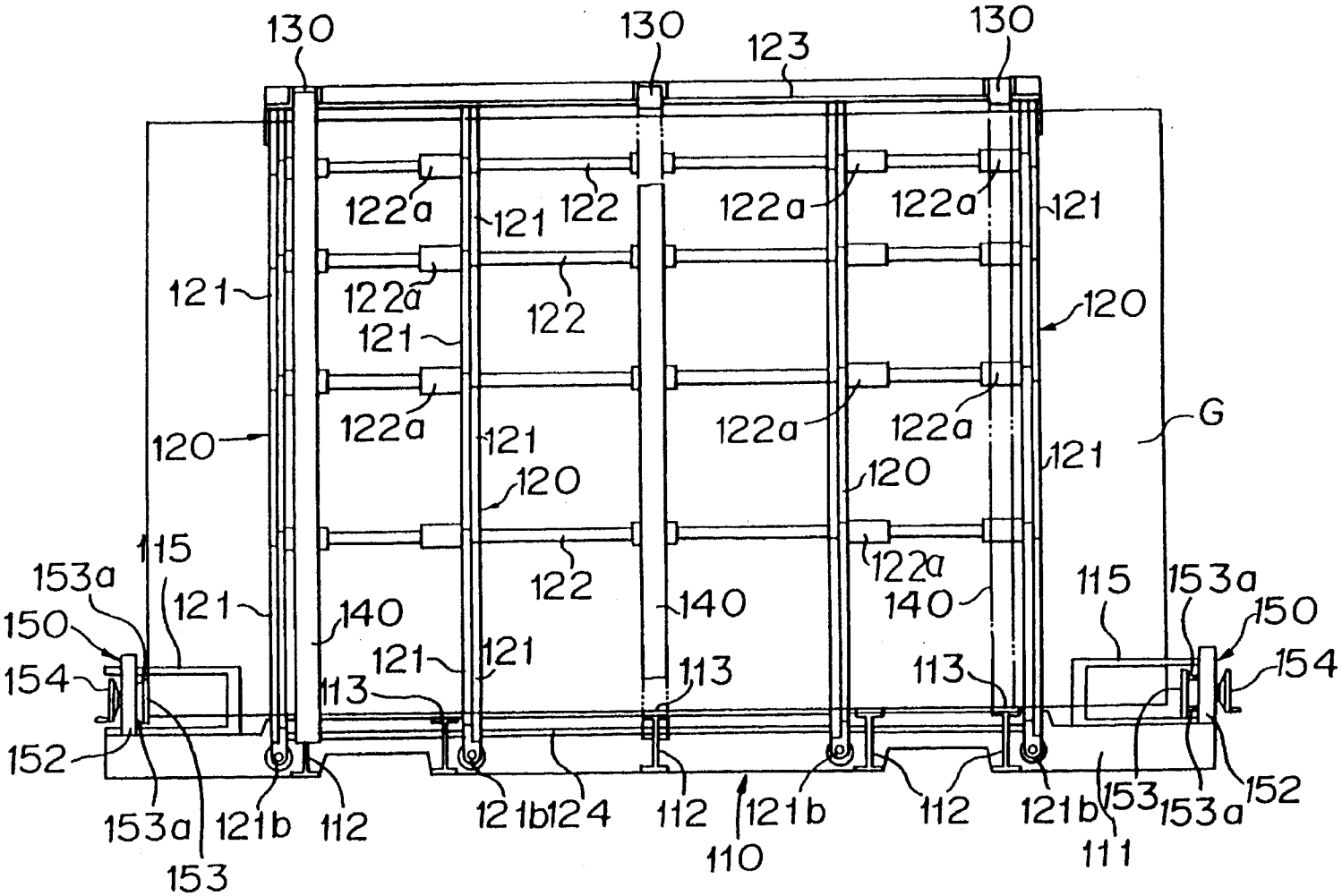
FIG. 10 is a front view of the rest shown in FIG. 9.

A rest for transporting glass plates has, as major elements, a base 110, extensible means 120, 120 . . . set up in an alignment form on and at the central portion of the base 110, upper pressing members 130, 130 . . . , front pressing members 140, 140 . . . , and side pressing members 150, 150 as shown in FIGS. 9 and 10. The rest can be received in the container for transportation C described above.

Figure 11:
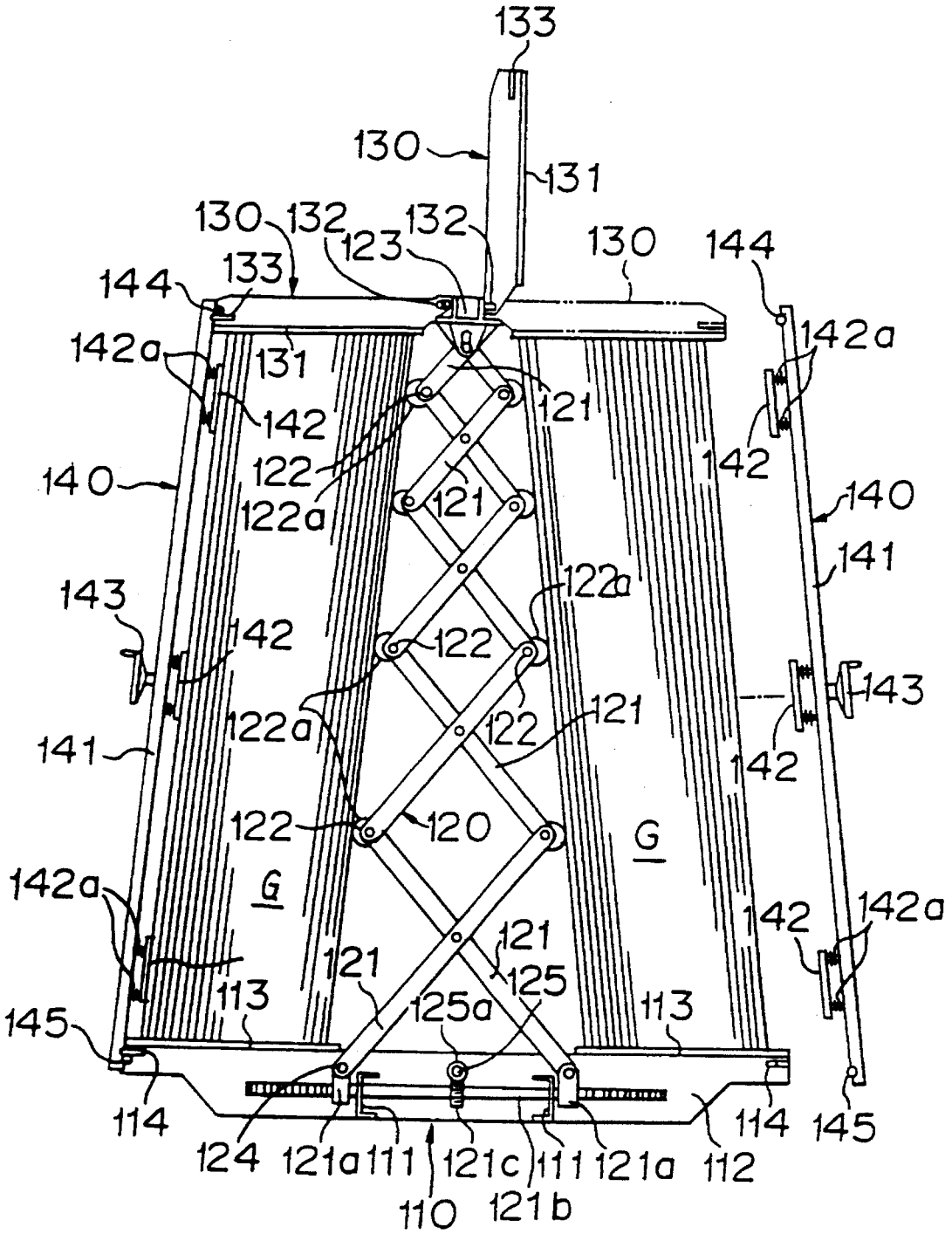
FIG. 11 is a side view of the rest shown in FIG. 9.

In FIGS. 10 and 11, the base is formed by assembling longitudinal bars, 111, 111 and lateral bars 112, 112 into a frame form. The longitudinal bars 111, 111 and the lateral bars 112, 112 . . . may be provided with notch portions at suitable positions so that they can be stably located on the bottom plate of the container for transportation C. Each of the lateral bars 112, 112, is projected on the left and right sides of each of the longitudinal bars 111, 111. On the upper surface of each of the lateral bars 112, 112, shock absorbing members 113 are provided so as to correspond to the projecting portion of the lateral bars with respect to the longitudinal bars 111, 111.

Each of the extensible means 120, 120 . . . is formed by assembling link arms 121, 121 . . . in an upright scissors form wherein the length of the assembled link arms is reduced successively from the bottom to the top. In each of the extensible means 120, 120 . . . , the link arms 121, 121 . . . are connected by connecting rods 122, 122 . . . for penetrating the joint portion of each of the link arms 121, 121. Also, the extensible means 120, 120 . . . are connected to a connection beam 123 at their top and connecting rods 124, 124 at their bottom. Each of the connecting rods 122 is provided with shock absorbing members 122*a*, 122*a*. Each of the shock absorbing members 22*a*, 22*a* is fitted to the connecting rod 122 so as to be eccentric to the outer side with respect to the extensible means 120 (FIG. 12).

A threaded member 121*a* is attached to the lower end of each lowermost link arm 121, 121 of the extensible means 120, and the connecting rods 124, 124 are connected to the threaded members 121*a*, 121*a*. A threaded shaft 21*b* is engaged with a pair of the threaded members 121*a*, 121*a*, and a worm wheel 121*c* is fixed to the intermediate portion of each of the threaded shafts 12l*b*. Male screws are formed at both end portions of each of the threaded shafts 21*b* wherein the male screws formed at the both end portions are reverse each other. Accordingly, when the threaded shafts 12l*b* are turned clockwisely or counter-clockwisely, the threaded members 121*a*, 121*a* come to close or are separated from each other along the threaded shafts 12l*b*.

Figure 12:
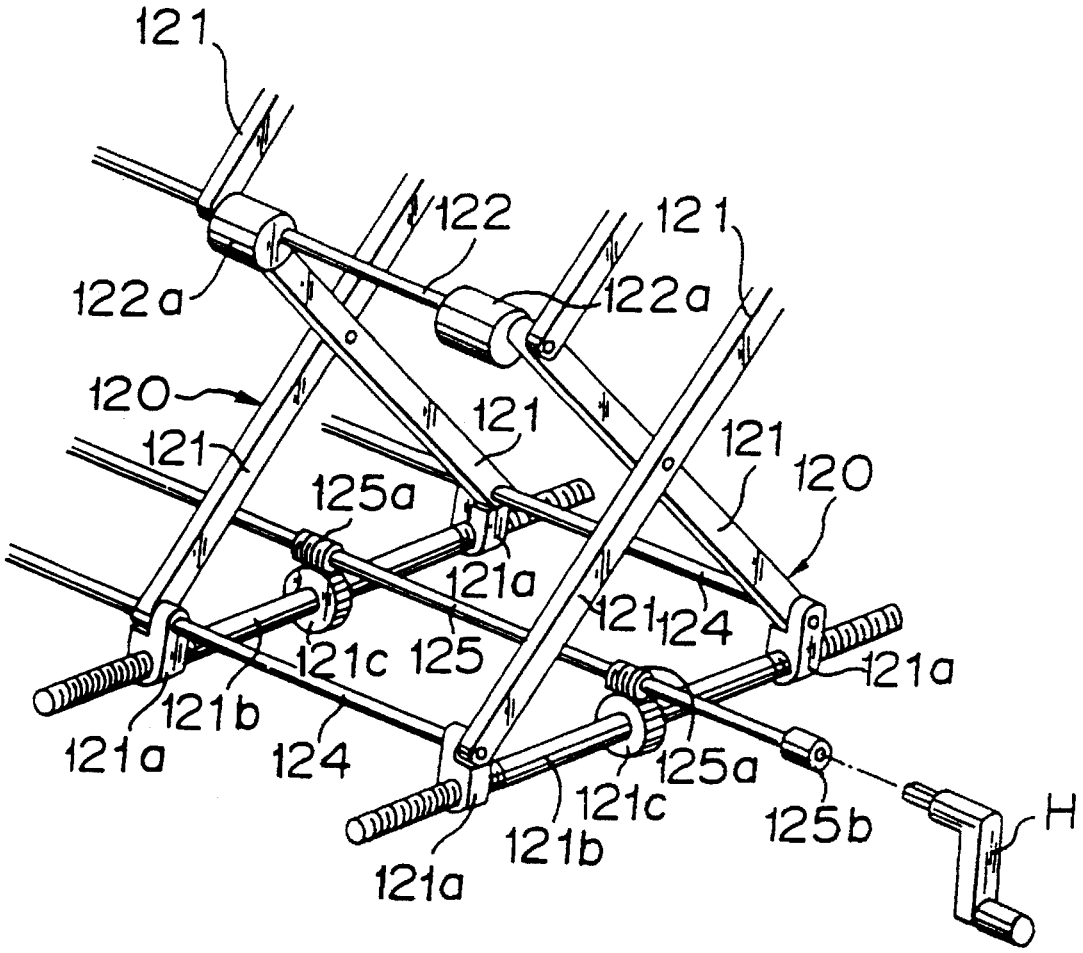
FIG. 12 is an enlarged perspective view partly broken of the rest shown in FIG. 9.

As shown in FIGS. 11 and 12, a driving shaft 125 are extended at the central portion of the base. A plurality of worms 125*a*,125*a* are fixed to the driving shaft 125 so as to be engaged with a worm wheel 21*c* for each of the extensible means 120. Both ends of the driving shaft 125 are extended to both ends of the base 110, and sockets 125*b* with a hexagonal hole are attached to the both ends of the driving shaft 125. When a crank handle A or an impact wrench is fitted to either of the sockets 125*b* and it is operated to turn the driving shaft 125 clockwisely or counter-clockwisely, the extensible means 120, 120 . . . can be simultaneously expanded or shrinked by simultaneous rotation of the threaded shafts 12l*b*, 121*b* . . . by means of the worms 125*a*, 125*a* . . . and the worm wheels 121*c*, 121*c* . . .

Figure 13:
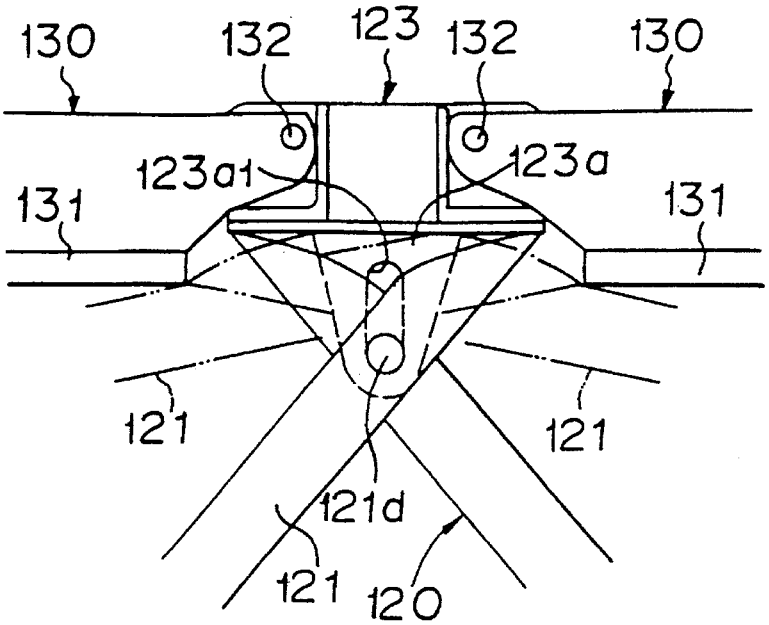
FIG. 13 is an enlarged view of a portion of the rest shown in FIG. 9.

In FIG. 13, a bracket 123*a* is provided on the lower surface of the connection beam 123 so as to correspond to each of the extensible means 120. The link arms 121, 121 located at the uppermost portion of each of the extensible means 120 has their top end portions of a knife shape so that they can open and close smoothly while they are in contact with the lower surface of the connection beam 123. The bracket 123*a* is provided with a vertically elongated hole 123*al* with which a pin 121*d* which connects link arms 121, 121 is engaged. With such construction, there is no danger of inclination of the connection beam 123 toward a lateral side since the posture of the connection beam can be kept constantly by means of the paired link arms 21, 21 and the vertically elongated hole 123*al* even when the extensible means 120, 120 . . . are expanded or shrinked to cause the vertical movement.

The upper pressing member 130, 130 . . . are respectively polygonal cylindrical members which are hinged symmetrically on the lateral side of the connection beam 123 (FIGS. 10 and 11). Namely, the upper pressing member 130, 130 . . . are attached to the top of each of the extensible means 120, 120 . . . by means of the connection beam 123.

The upper pressing members 130 are provided at both end portions and the central portion of the connection beam 123 so as to correspond to the lateral bars 112, 112 . . . arranged at the both end portions and the central portion of the base 110 wherein the length of the upper pressing members 130 is slightly shorter than a half length of the lateral bars 12. Shock absorbing members 131 are provided at the lower surface of the upper pressing members 130. Each of the upper pressing members 130 connected to a side of the connection beam 123 by means of a hinge pin 132 so that it can be opened upwardly at substantially a vertical position around the hinge pin 132. When the upper pressing member 130 is turned downwardly, the position of the upper pressing member 130 is determined by making it contact with a lower side end of the connection beam 123 (FIG. 13), so that it can be kept at a horizontal position as shown in two-dotted chain line in FIG. 11.

Figure 14:
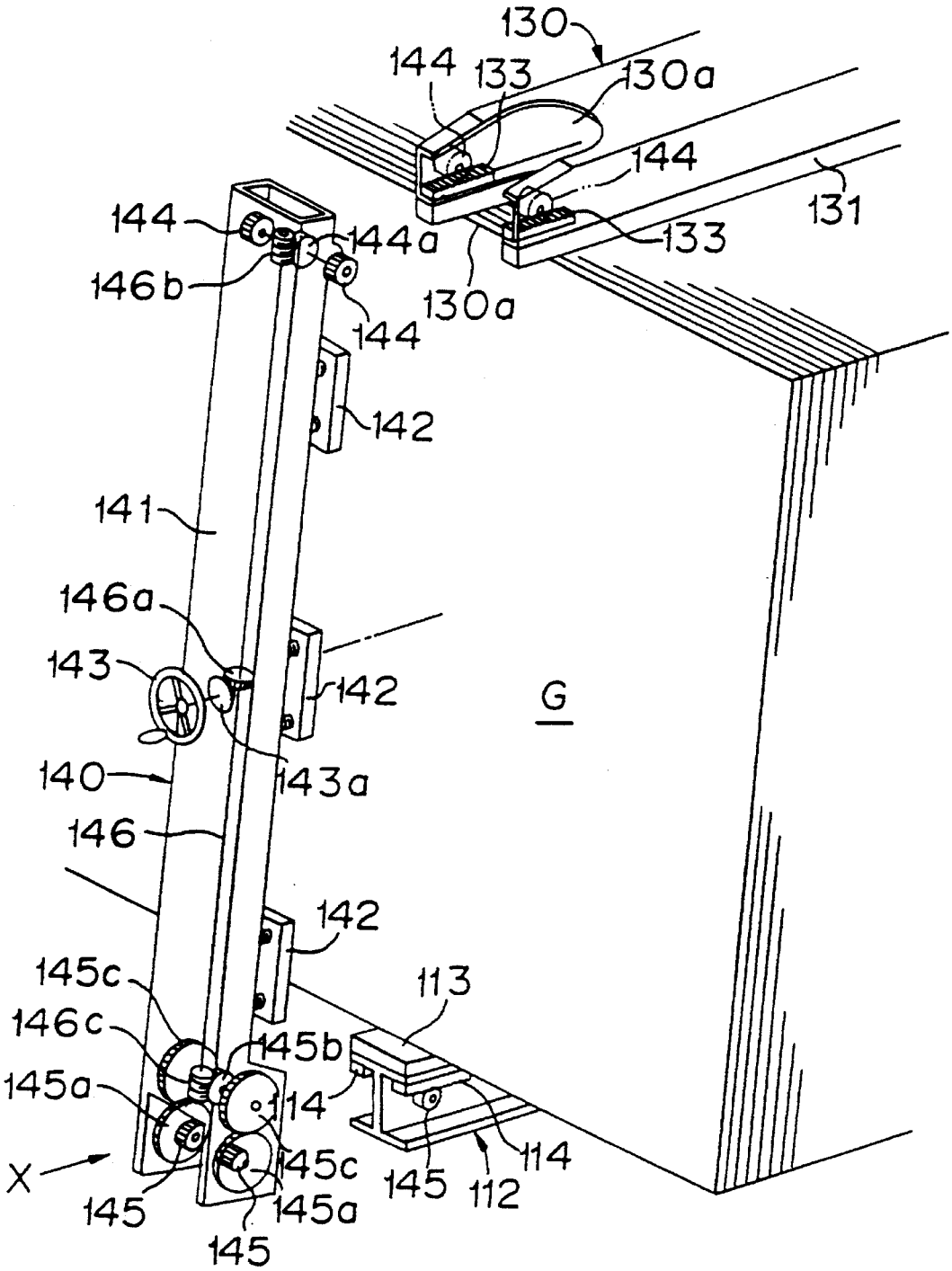
FIG. 14 is a perspective view in a disassembled state of a portion of the rest shown in FIG. 9.
Figure 16:
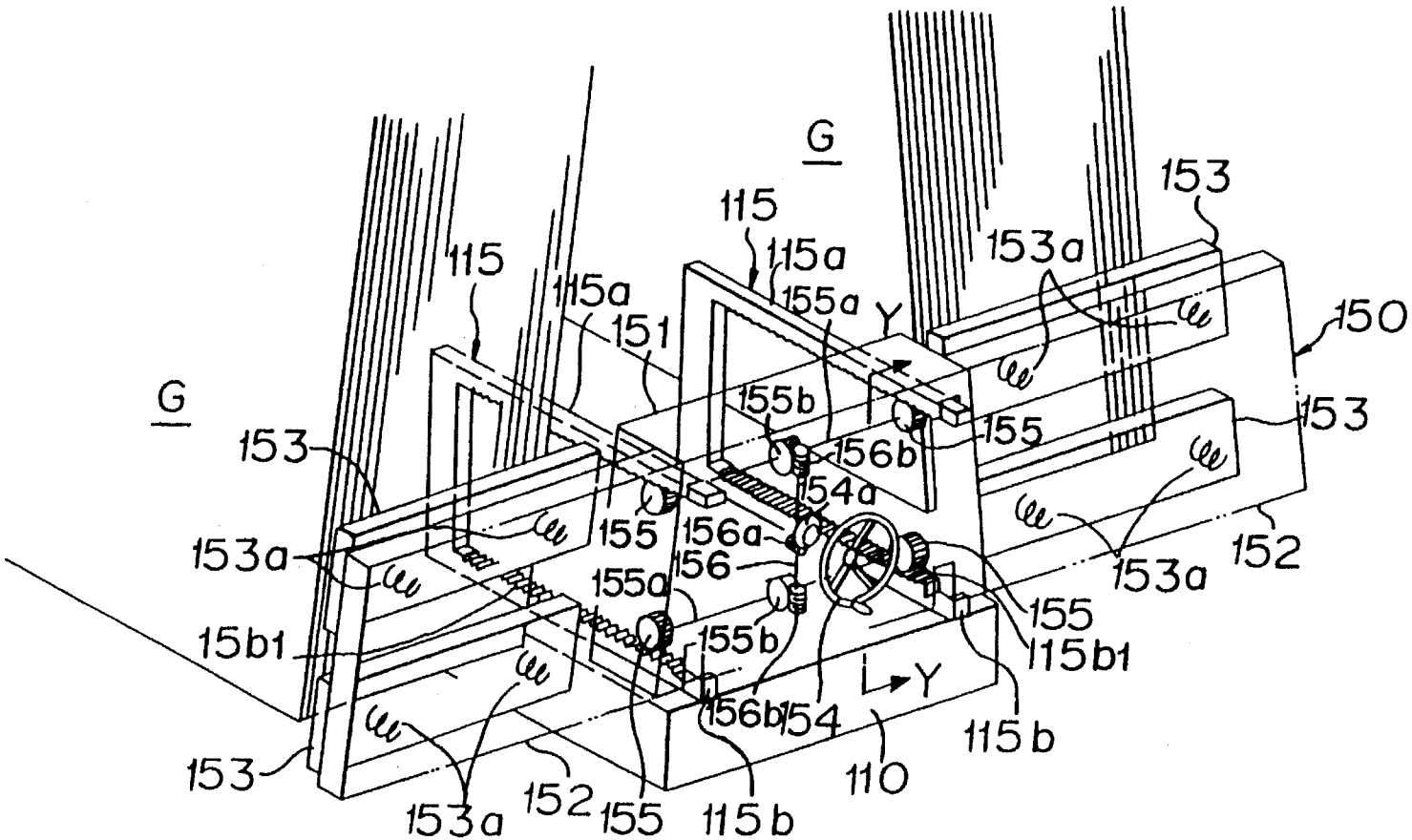
FIG. 16 is an enlarged perspective view of a portion of the rest.

In FIG. 14, each end portion of each of the upper pressing members 130 is provided with notches 130*a*, 130*a* at the upper and lower portions in its longitudinal direction so as to provide a fork-like end portion. At the inner portion of the forked end portion, racks 133, 133 are provided to direct upwardly.

In FIGS. 9 and 11, each of the front pressing members 140, 140 . . . is connectable to the upper pressing member 130 and the lateral bar 112 of the base 110 and detachable therefrom in a state that the extensible means 20 is expanded and is kept at a horizontal position. The front pressing members 140, 140 . . . are located in parallel to an inclination surface formed by the shock absorbing members 122*a*, 122*a* . . . of the extensible means 20, 20 . . . in an expanded state by determining the length of the upper pressing members 130, 130 . . . and the lateral bars 12, 12 . . . suitably.

Figure 15:
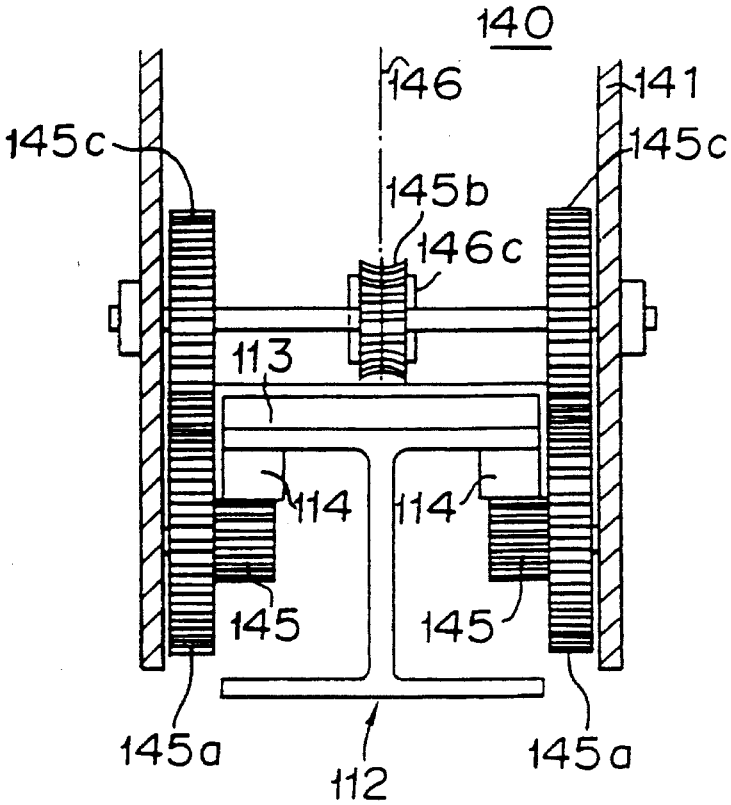
FIG. 15 is an enlarged side view of a portion of the rest.

In FIGS. 11 and 15, each of the front pressing members 140 comprises a rectangular tube-like support member 141 and movable plates 142, 142 . . . attached to the inner surface of the support member 141 wherein each of the movable plates 142 is fixed to the support member 141 by means of compression springs 142*a*. In the support member 141, a driving handle 143, upper pinions 44, 44 and lower pinions 145, 145 are assembled.

Referring to FIGS. 14 and 15, the upper pinions 144, 144 are pivotally held at the upper end portion of the support member 141 so as to project on the left and right sides of the support member 141, and the lower pinions 145, 145 are pivotally held together with auxiliary pinions 145*a*, 145*a* at the lower end portion of the inside of the support member 141. At the lower end portion of the support member 141, only left and right side walls are extended in order to pivotally hold the lower pinions 145, 145 and the auxiliary pinions 145*a*, 145*a* so as to project inside of the support member 141.

Inside the support member 141, a driving shaft 46 is extended in the longitudinal direction, and the driving handle 143 is connected to the driving shaft 146 through bevel gears 143*a*, 146*a*. The driving shaft 146 is connected to the upper pinions 144, 144 by means of a worm gear 146*b* and a worm wheel 144*a*. The driving shaft 146 and the lower pinions 145, 145 are driven by a worm 146*c* fixed to the lower end of the driving shaft 146 and worm wheels 145*b*, 145*b* engaged with the worm 146*c* through the auxiliary pinions 145*a*, 145*a*, the auxiliary pinions 145*c*, 145*c* engaged with the auxiliary pinions 45*a*, 45*a*. Racks 114, 114 which direct downwardly are provided at end portions of the lateral bars 112, 112 which correspond to the front pressing members 140, the racks 114, 114 being capable of engaging with the lower pinions 145, 145. The upper pinions 144, 144 can be engaged from the upper portion with the racks 133, 133 directing upwardly which are positioned at the end portion of the upper pressing member 130.

The front pressing member 140 can be moved front and back while it can keep the same posture. The upper pinions 144, 144 are engaged from the upper portion with the racks 133, 133, and the lower pinions 145, 145 are engaged with the racks 114, 114. Then, the driving handle 143 is turned clockwisely or counter-clockwisely. Then, the upper pinions 144, 144 and the lower pinions 145, 145 are respectively moved front and back along the racks 133, 133, 114, 114 so that the front pressing member 140 can be moved front and back as a whole. Further, the front pressing member 140 can be easily removed from the upper pressing member 130 and the lateral bar 13 by retracting the upper pinions 144, 144 and the lower pinions 145, 145 to the edge portions of the racks 133, 133, 114, 114 (the right side of FIG. 11).

Figure 17:
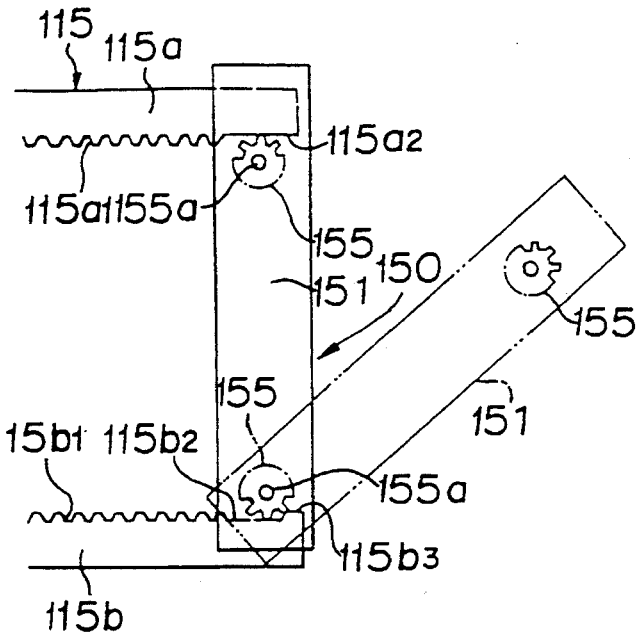
FIG. 17 is an enlarged front view of a portion of the rest.

In FIGS. 10 and 17, the side pressing member 150, 150 are arranged at both end portions in the longitudinal direction of the base 110 so as to face each other.

Each of the side pressing members 150 comprises a main body frame 151 in a trapezoidal shape, sleeve frames 152, 152 to be provided at both sides of the main body frame 151 and movable plates 153, 153 located inside the sleeve frames 152. Each of the movable plates 153 is attached to the sleeve frame 152 by means of compression springs 153*a*, 153*a*.

A driving handles 154 is held by the main body frame 151, and a pair of upper and lower driving shafts 155*a*, 155*a* each having pinions 155, 155 at both ends are installed on the main body frame 151. The driving handle 154 is connected to a connecting shaft 156, which is disposed in an intermediate portion between the driving shafts 155*a*, 155*a*, by mean of bevel gears 154*a*, 156*a*. Worms 156*b*, 156*b* at upper and lower end portions of the connecting shaft 156 are engaged with worm wheels 150*b*, 150*b* fixed to the driving shafts 155*a*, 155*a*.

Figure 18:
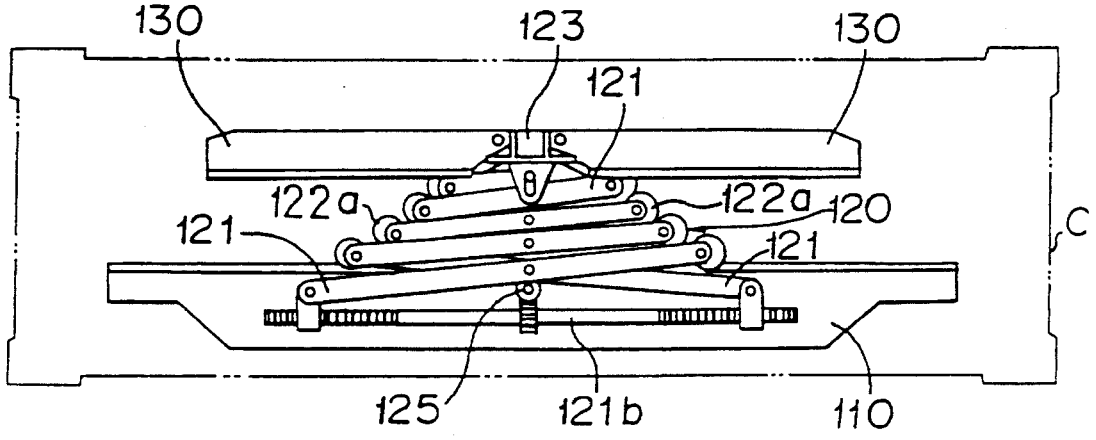
FIG. 18 is a front view of the rest in a folded state.

Referring to FIGS. 17 and 18, a pair of ⊐-shaped rack members 115, 115 are positioned in parallel to each other on the base 110. At the upper side 15*a* and the lower side 115*b* of each of the racked members 115, downwardly and upwardly directing racks 115*al*, 115*bl* are respectively formed. The upper pinions 155, 155 of the side pressing member 150 are engaged with the downwardly directing racks 115*al*, 115*al* of the rack members 115, 115, and the lower pinions 155, 155 are engaged with the upwardly directing racks 115*bl*, 115*bl*. The upper sides 115*a*, 115*a* and the lower sides 115*b*, 115*b* of the rack members 115, 115 penetrate longitudinally the main body frame 151, and the upper sides and the lower sides of the rack members 115, 115 are provided respectively with flat portions 115*a*2, 115*b*2 which correspond to the valley portion of the racks 115*al*, 115*bl*. At the end portion of the lower sides 115*b*, 115*b*, projections 15*b*3 corresponding to the ridge portion of the racks 115*bl*, 115*bl* are formed. By turning the driving handle 154 clockwisely or counterclockwisely, the pinions 155, 155 are rotated whereby the side pressing member 150 is moved as a whole forwardly and backwardly along the rack members 115, 115. When the side pressing member 150 is retracted to the rearmost position so that the pinions 155, 155 . . . correspond to the flat portions 115*a*2, 115*a*2, 115*b*2, 115*b*2, the side pressing member 50 can be opened backwardly as a whole (two-dotted chain line in FIG. 17). The lower pinions 155, 155 are engaged with the projections 115*b*3, 115*b*3 formed in the lower sides 115*b*, 115*b* of the rack members 115, 115 whereby they seldom come off from the lower sides 115*b*, 115*b*. Further, the main body frame 151 can incline at a predetermined angle since the lower pinions 155, 155 roll on the flat portions 115*b*2, 115*b*2. In a backwardly opened state of the side pressing member 150, the side pressing member 150 can be easily removed by removing the engagement of the lower pinions 155, 155 from the projections 115*b*3, 115*b*3 while the side pressing member 150 is more or less raised.

In a case that the rest for transporting the glass plates is in a stretching state by expanding the extensible means 120, 120 . . . , a large number of glass plates G, G can be loaded on the rest by resting uprightly the glass plates on the both sides of the extensible means 120, 120 . . . (FIGS. 9 and 11). When the glass plates G, G are loaded, the front pressing members 140, 140 . . . are removed. The upper pressing members 130, 130 . . . are opened upwardly, and at least one of the side pressing members 150, 150 is opened backwardly at the retracted position.

After a predetermined number of glass plates G, G are loaded, the upper pressing members 130, 130 . . . are closed in a horizontal position, and the front pressing members 140, 140 . . . are fitted to the rest. Then, the side pressing members 150, 150 are set in the regular position and the driving handles 154, 154 are rotated to forwardly move the side pressing members 150, 150. Accordingly, the side pressing members 150, 150 push with a spring action outer faces of the glass plates G, G through the movable plates 153, 153 . . . and the compression springs 153*a*, 153*a* . . . whereby the position in the width direction of the side pressing members 150, 150 are set. In this case, either one or both of the side pressing members 150, 150 may be operated.

The driving handle 143 for each of the front pressing members 40 are rotated to forwardly move the front pressing members 140. Accordingly, the front pressing members 140, 140 . . . push with a spring action the outer surface of the glass plates G, G through the respective movable plates 140, 140 and the compression springs 142*a*, 142*a* . . . , whereby the glass plates G, G can be fixed stably in its entirety. Each of the front pressing members 140 can be positioned regularly by engaging from the upper portion, the upper pinions 144, 144 with the racks 133, 133 of the upper pressing member 130. Accordingly, there is no danger of the opening upwardly of the upper pressing member 132 inadvertently.

Loading operations of the glass plates G, G can be easily done by opening the upper portion of a foldable type container for transportation C described above.

The glass plates G, G can be unloaded at an addressed place by using reverse steps to the assembling operations of described above. Namely, firstly, the front pressing members 140, 140 . . . are refracted and removed; the upper pressing members 130, 130 . . . are opened upwardly, and the side pressing members 150, 150 are retracted and opened backwardly. Then, the glass plates G, G can be easily unloaded. In this case, it is sufficient that either one or both of the side pressing members 50, 50 are retracted.

After the unloaded operations, the height of the rest can be reduced to one third or less by shrinking the expansible means 120, 120 . . . (FIG. 18). Namely, the folded rest for transportation is received, together with the front pressing members 140, 140 . . . removed from the rest in the container for transportation C of a foldable type which has also been folded to have a height of one third, which is to be returned to a place of shipment.

In the rest described above, either one of the side pressing members 150, 150 may be moved forwardly and backwardly, and the other may be fixed to the base 110.

Further, the length of the racks 133, 133, 114, 114 may be increased to increase the strokes of the front pressing member 140 for forward and backward movement so that the rest can be conveniently used for a small quantity of glass plates G, G.

In the rest having the construction described above, the extensible means comprises link arms assembled in a scissors shape wherein the length of the link arms are successively reduced from the bottom to the top. Accordingly, the extensible means, when in an expanded state, can form slant surfaces for resting glass plates at both sides. Further, the front pressing member is adapted to bring the respective glass plates on the slant surfaces, and the side pressing member is capable of pushing the glass plates so as to clamp them from both sides. Accordingly, they can stably fix the respective glass plates in association with the upper pressing member.

In particular, the rest used for the container for transportation of the present invention comprises the base, a plurality of extensible means which are arranged in an alignment form at the central portion of the base and which is formed by assembling link arms in a scissor shape wherein the length of the link arms are reduced successively from the bottom to the top, the upper pressing members, the front pressing members and the side pressing members. Accordingly, the height of the extensible means can be reduced to one third or less when the rest is in non-use, and further, shrinking operations are very easy. Therefore, an empty foldable type container for transportation can be effectively used when it is returned to a place of shipment, and treatment for loading operations and unloading operations can be very easy.

Further, since connecting rods with a shock absorbing member are used to connect the extensible means, the connecting rods can reinforce the extensible means, and can suitably disperse the load of rested glass plates through the shock absorbing members.

Further, the front pressing members may be removable, and the upper pressing members may be opened upwardly. In this case, when the side pressing members are to be opened backwardly, the upper surface of the base can be opened widely whereby loading operations for the glass plates are further easy.

Thus, in accordance with the container for transportation of the present invention, shutters constitute left and right side walls which can be wound up in the ceiling portion; end plates are connected to the ceiling portion so as to be foldable, and columns are provided at both side portions of the end plates. These members are formed integrally with the ceiling portion. After the shutters have been wound up in the ceiling portion, the ceiling portion is lifted up by a crane, and the entire structural elements except the base portion can be raised together. When the ceiling portion is lowered to a floor surface, the end plates can be easily folded along with the columns. Further, the ceiling portion which has accommodated the wound-up shutters and the folded end plates is overlaid on and connected to the base portion, whereby the outer volume of the overlaid container can be reduced to a divided portion.

In the present invention, it is unnecessary to treat structural elements individually. Accordingly, the number of structural elements to be treated can be minimized. Accordingly, labor for the folding and reassembling operations can be remarkably reduced.

When the end plates can be expansible and shrinkable in their width direction, it is sufficient to prepare a further small space for the end plates in a case that they are accommodated in the ceiling portion.

Further, by mounting casters to the end plates, further smooth folding operations are possible by utilizing the deadweight of the ceiling portion.

Further, when the ceiling portion is provided with a lifting means, the lifting means can lift the folded end plates so that they are brought to the lower surface of the ceiling and are accommodated in it. Accordingly, the height of the ceiling portion to accommodate the end plates can be further reduced.

Obviously, numerous modifications and variations of the present invention are possible in light of the above teachings. It is therefore to be understood that within the scope of the appended claims, the invention may be practiced otherwise than as specifically described herein.

What is claimed is:

1. A container for transportation which comprises:

a base portion, a ceiling portion, side wall members for forming left and right side walls and end plates for closing front and rear openings formed by the base portion, the ceiling portion and the left and right side walls, wherein said end plates are connected to the ceiling portion, and each of the end plates extended in a respective plane and each of said end plates includes left and right sides, and further wherein each of said end plates includes columns at the left and right sides, and wherein said end plates each include a width extending from the left side to the right side, and each of said end plates is expandable and retractable in their respective planes to thereby provide retracted and expanded positions with said width reduced in said retracted position as compared with said expanded position, and wherein said ceiling portion receives said end plates in said retracted position.

2. A container for transportation which comprises:

a base portion, a ceiling portion, side wall members for forming left and right side walls and end plates for closing front and rear openings formed by the base portion, the ceiling portion and the left and right side walls, wherein said end plates are pivotally connected to and received within the ceiling portion, and each of the end plates includes left and right sides, and wherein each of the end plates is provided with columns at the left and right sides with said columns detachably connected to the base portion and the ceiling portion, and wherein each of the end plates includes a lower portion and each of the end plates is provided with casters at the lower portion.

3. A container for transportation which comprises:

a base portion, a ceiling portion, side wall members for forming left and right side walls and end plates for closing front and rear openings formed by the base portion, the ceiling portion and the left and right side walls, wherein said end plates are connected to the ceiling portion, and each of the end plates includes left and right sides, and wherein each of the end plates is provided with columns at the left and right sides with said columns detachably connected to the base portion and the ceiling portion, and wherein the ceiling portion includes a lifting means for lifting and receiving the end plates in the ceiling portion.

4. The container for transportation according to claim 1, wherein the side wall members are shutters which are windable up to the ceiling portion.

5. The container for transportation according to claim 1, further including a rest disposed inside of said container, said rest comprising a base having a central portion and two end portions, a plurality of extensible means which are aligned along a common axis on the central portion of the base, said extensible means having a bottom and a top, and each of said extensible means includes a pair of assembling link arms in a scissors form wherein each pair of assembling link arms has a length from a top to a bottom of said arms and the length of each pair of assembling link arms is incrementally reduced from the bottom to the top of each extensible means, the rest further including upper pressing members attached to the top of each of the extensible means, front pressing members for connecting the upper pressing members to the base and side pressing members located at both end portions of the base.

6. The container of claim 1, wherein at each of said columns, said container includes first, second, third and fourth connector parts, said first connector part disposed on said base portion, said second connector part disposed on a bottom of said column and mating with said first connector part, said third connector part disposed on a top of said column, said fourth connector part disposed on said ceiling portion and mating with said third connector part, and wherein when said end plates are in the retracted position and disposed in said ceiling, said fourth connector part mates with said first connector part to provide a collapsed position of said container.

7. The container of claim 1, wherein said end plates are pivotably connected to said ceiling portion.

8. The container of claim 1, further including drive means for moving said end plates between the retracted and expanded positions.

9. The container of claim 1, wherein said end plates each include a fixed plate and a movable plate with said movable plate movable relative to said fixed plate in the respective plane of said end plates.

10. The container of claim 1, wherein each of said end plates includes a fixed plate and a pair of movable plates, said fixed plate disposed between said pair of movable plate, and wherein one of said columns is connected to each of said movable plates.

11. The container of claim 10, further including drive means for moving said pair of movable plates toward one another.

* * * * *